United States Patent [19]

Escamilla-Kelly

[11] 4,448,420

[45] May 15, 1984

[54] UPRIGHT GAME WITH INSERTABLE DICE

[76] Inventor: Ricardo Escamilla-Kelly, 8374 Leamont, Houston, Tex. 77072

[21] Appl. No.: 346,541

[22] Filed: Feb. 8, 1982

[51] Int. Cl.[3] ..... A63F 3/00

[52] U.S. Cl. ..... 273/241; 273/272

[58] Field of Search ..... 273/241, 272, 285, 271; D21/23, 24

[56] References Cited

U.S. PATENT DOCUMENTS

| | | | |
|---|---|---|---|
| 3,427,028 | 2/1969 | Abrahamsen | 273/272 |
| 3,462,150 | 8/1969 | Eriksson | 273/285 X |
| 3,506,267 | 4/1970 | Taillie | 273/271 X |
| 3,523,377 | 8/1970 | Gardner | 273/272 X |
| 3,584,874 | 6/1971 | Clark | 273/285 X |
| 3,770,273 | 11/1973 | Reiner | 273/272 X |

OTHER PUBLICATIONS

*Scarne's Encyclopedia of Games,* John Scarne ©1973, pp. 440, 441, 445, 446.

*Primary Examiner*—Richard C. Pinkham
*Assistant Examiner*—Scott L. Brown
*Attorney, Agent, or Firm*—Neal J. Mosely

[57] ABSTRACT

A game of skill is disclosed which consists of a playing grille having square shaped openings formed of sheet material of a depth such that the openings are each substantially cubic in dimensions. The grille is supported with the openings disposed horizontally in parallel relation with one opening at the bottom and succeeding rows of 3, 5, 7, 5, 3 and 1 openings, respectively. The grille therefore consists of 25 openings, accessible from either side, in an array as just described. The game also includes 25 dice, each of a size just fitting the openings in the grille. The game is played by two players inserting individual dice, in turn, from opposite sides of the grille. Whenever a player inserts a die which produces a sum of three or more dice equal to a multiple of seven, he scores such a sum. The sums of dice may be up-down, sideways or diagonal. The game continues, restarting if necessary, until one player reaches 1000 points (or other agreed score). Bonus points are provided to a player who reaches an exact score of 70 or 700 in the course of play.

3 Claims, 2 Drawing Figures

UPRIGHT GAME WITH INSERTABLE DICE

BACKGROUND OF THE INVENTION

1. Field of the Invention

This invention relates to new and useful improvements in game apparatus, and more particularly to a novel game grille having a multi-level construction for competitive play with dice.

2. Description of the Prior Art

One of the best references on board and table games is a book "BOARD AND TABLE GAMES FROM MANY CIVILIZATIONS", by R. C. Bell, Dover Publications, Inc. Games are divided into a variety of types of board and table games including race games, war games, positional games, dice games, dominoes, etc. Some board games involve the movement of pieces around various types of tracks or paths in accordance with the operation of chance devices such as dice. Other board games, such as checkers or chess, involve the movement of playing pieces according to the rules of the game.

Board games involving the use of chance devices usually have a large element of chance in the play of the game. Games in which pieces are moved strictly according to the rules of play are either games which are largely of skill or games which are fatalistic, i.e. the winning or losing of the game is determined by which player starts. The use of dice in various types of games is well known and there are chance games using dice ranging from the use of a single die through the use of two or three dice up to games utilizing a very large number of dice. In all of these games, however, the use of dice is strictly as a means for producing a chance result. The use of dice as playing pieces in games which are strictly of skill does not appear to be known.

SUMMARY OF THE INVENTION

One of the objects of this invention is to provide a new and improved multi-level grille and dice game apparatus.

Another object of this invention is to provide a new and improved game apparatus of the type using dice for playing pieces instead of as chance devices.

Still another object of this invention is to provide a new and improved game apparatus which is played competitively as a game of skill in which a plurality of dice are placed in a supporting grille in an effort to produce a maximum score.

Other objects of this invention will become apparent from time to time throughout thge specification and claims as hereinafter related.

These and other apparent objects of the invention are accomplished by a game of skill which consists of a playing grille having square shaped openings formed of sheet material of a depth such that the openings are each substantially cubic in dimensions.

The grille is supported with the openings disposed horizontally in parallel relation with one opening at the bottom and succeding rows of 3, 5, 7, 5, 3 and 1 openings, respectively. The grille therefore consists of 25 openings, accessible from either side, in an array as just described. The game also includes 25 dice, each of a size just fitting the openings in said grille.

The game is played by two players inserting individual dice, in turn, from opposite sides of the grille. Whenever a player inserts a die which produces a sum of three or more dice equal to a multiple of seven, he scores such a sum. The sums of dice may be up-down, sideways or diagonal. The game continues, restarting if necessary, until one player reaches 1000 points (or other agreed score). Bonus points are provided to a player who reaches an exact score of 70 or 700 in the course of play.

DESCRIPTION OF THE PREFERRED EMBODIMENTS

Figure 1:
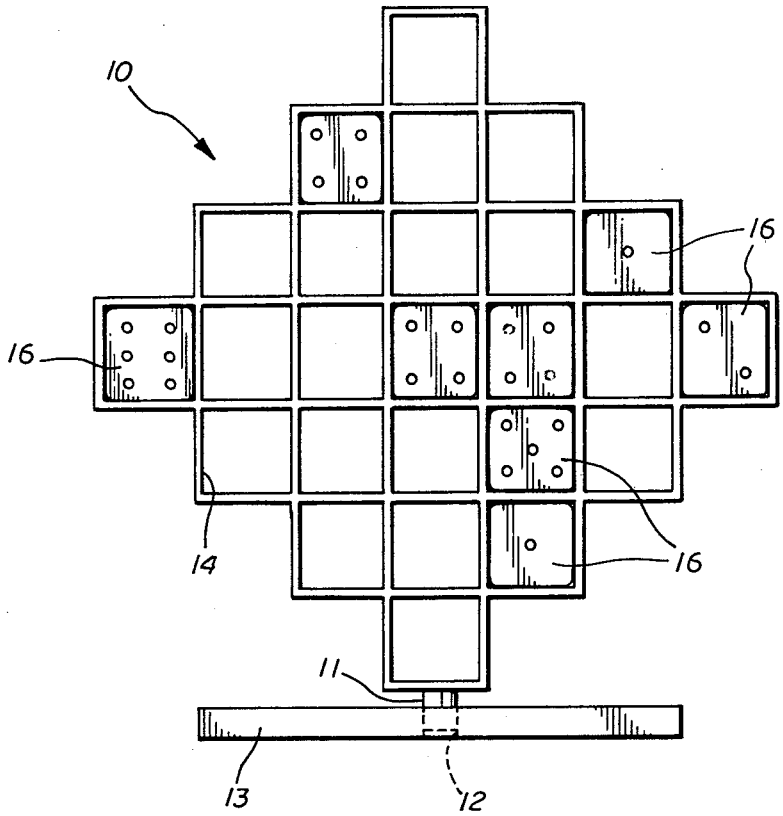
FIG. 1 is a view in front elevation of a preferred embodiment of a novel multi-level game grille apparatus for play with dice.
Figure 2:
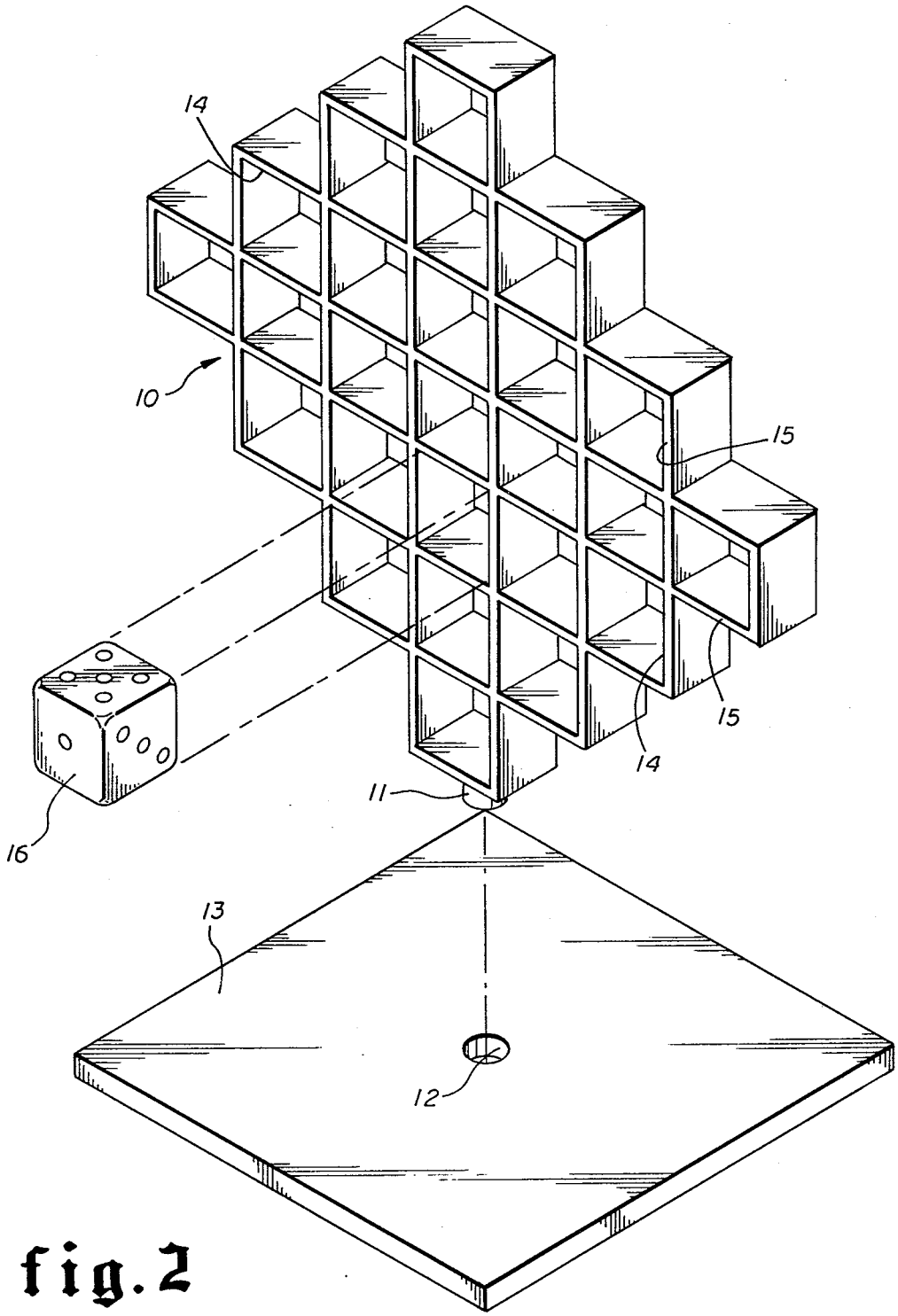
FIG. 2 is an isometric view of the embodiment of the game grille apparatus shown in FIG. 1 with the dice shown in exploded relation and the grille exploded in relation to its support.

Referring to the drawings by numerals of reference, there is shown a preferred embodiment of the invention in FIGS. 1 and 2. The invention consists of a game of skill for two players. The game consists of a grille 10 having a supporting peg 11 which fits into a hole or aperture 12 an a square base 13.

Grille 10 has a plurality of compartments or openings 14 of square shaped cross section. The grille is formed of a sheet material providing thin walls 15 which define the compartments or openings 14. The walls 15 are of a depth substantially equal to one side of the square shaped compartments or openings 14. Each of the compartments or openings 14 therefore have dimensions which are cubic. The grille 10 is preferably formed of a single material such as a molded or extruded plastic. Other material could be used to form grille 10 such as ceramic, metal, wood, etc.

Grille 10 is provided with the compartments or openings 14 arranged in horizontal, parallel relation when installed in a vertical position on supporting base 13. Compartments or openings 14 are square in cross section with cubic dimensions and are arranged in a pattern beginning with one opening at the bottom and vertically succeding, horizontally extending rows of 3, 5, 7, 5, 3, and 1 compartments or openings, respectively. The grille therefore consists of 25 compartments or openings which are accessible from either side in an array as just described.

The game has a plurality of dice 16 which are of a size just fitting inside the compartment or opening 14 and filling the grille from front to rear. The game is provided with a number of dice which is equal to the number of the openings 14, i.e. 25 dice for the grille 10 shown in FIGS. 1 and 2. The game is played with two players who alternately insert dice from opposites sides of the grille 10 into compartments or openings 14 in accordance with the rules of the game which will be subsequently described.

PLAY OF THE GAME

In the play of the game, the players alternate placing one die 16 at a time into any open compartment or opening 14 on grille 10. In the play of the game, the object is to produce combinations of dice which total some multiple of 7. Under the rules of the game, a score is produced only by the total of three or more adjacent dice.

The dice may be aligned linearly up and down or side to side or may be aligned diagonally. In either case a player who inserts a die which produces a combination of three or more dice totaling a number which is a multiple of seven scores that number. The game continues and scores accumulated for each player.

The game may be restarted when the grille 10 is full of dice, and play continued until a selected game number, e.g. 1000 points, is reached. In addition, a bonus is given for a player reaching an exact score of 70 or 700. A player who reaches a score of 70, roles one die and obtains a bonus of 5 times the number rolled. A player who reaches exactly 700 rolls two dice and reaches a bonus of 7 times the number rolled. If a 7 is rolled at this point, the bonus is 100 points. Since the player who starts the game has a slight advantage, the loser of the first round starts the second round, etc.

While this invention have been described fully and completely with special emphasis upon a single preferred embodiment thereof, it should be understood that, within the scope of the appended claims, the invention may be practiced otherwise than as specifically described herein.

I claim:

1. A two-person competitive game of skill comprising a playing grille having 25 square shaped openings, each being substantially cubic in dimensions, said grille having said openings disposed horizontally in substantially parallel relation and being arranged in a pattern having both in-line and diagonally positioned openings, twenty-five conventionally numbered dice of a size just fitting said openings, used as non-chance playing pieces by the players, said dice being played alternately by each player inserting a die into one of said openings from opposite sides of said grille in an effort to produce a score which is a multiple of seven by addition of the number on the face of the die to the numbers on the faces of at least two dice aligned linearly or diagonally therewith, said grille having a support, the portion of said grille adjacent to said support having only one opening, and the remaining openings of said grille being arranged in successive rows of 3, 5, 7, 5, 3 and 1 openings arranged symmetrically.

2. A game of skill according to claim 1 in which said grille has thin-walled sheet material defining openings of square cross-section and having a depth substantially the same as a side of the openings.

3. A two-person competitive game of skill comprising a playing grille having 25 square shaped openings, each being substantially cubic in dimensions, said grille having said openings disposed horizontally in substantially parallel relation and being arranged in a pattern having both in-line and diagonally positioned openings, said grille has thin-walled sheet material defining openings of square cross-section and having a depth substantially the same as a side of the openings, twenty-five conventionally numbered dice of a size just fitting said openings, used as non-chance playing pieces by the players, said dice being played alternately by each player inserting a die into one of said openings from opposite sides of said grille in an effort to produce a score which is a multiple of seven by addition of the number on the face of the die to the numbers on the faces of at least two dice aligned linearly or diagonally therewith, said grille is formed of molded plastic and includes a removable support, the portion of said grille adjacent to said support having only one opening, and the remaining openings of said grille being arranged in successive rows of 3, 5, 7, 5, 3 and 1 openings arranged symmetrically.

* * * * *